US005212331A

United States Patent [19]

Waldo

[11] Patent Number: 5,212,331

[45] Date of Patent: May 18, 1993

[54] MUSICAL INSTRUMENT

[76] Inventor: Geoferey S. Waldo, 5721 Oakmeadow La., #2206, Raleigh, N.C. 27612

[21] Appl. No.: 802,498

[22] Filed: Dec. 5, 1991

[51] Int. Cl.[5] ..... G10O 13/08

[52] U.S. Cl. ..... 84/404

[58] Field of Search ..... 84/402, 404; 446/419

[56] References Cited

U.S. PATENT DOCUMENTS

| | | | |
|---|---|---|---|
| 408,635 | 8/1889 | Sommer | 84/404 |
| 3,698,128 | 10/1972 | Moeser | 46/175 |
| 4,165,671 | 9/1979 | DeBose | 84/402 |
| 4,179,973 | 12/1979 | White | 84/402 |
| 4,306,485 | 12/1981 | Rudkin | 84/402 |
| 4,901,617 | 2/1990 | Malone et al. | 84/402 |

*Primary Examiner*—Michael L. Gellner
*Assistant Examiner*—P. J. Stanzione
*Attorney, Agent, or Firm*—Basile and Hanlon

[57] ABSTRACT

A hand-operated musical instrument has a hollow tubular member with closed ends and a plate spacedly located adjacent one end thereof. An aperture in the plate allows the flow of loose filler particles from the first chamber formed between the plate and the first end of the tubular member into a second chamber formed between the plate and the opposite second end of the tubular member. Resonant tone pegs are mounted in and extend through the second chamber in the tubular member. The ends of the tone pegs are spaced from an opposite side wall of the tubular member. The tone pegs are struck by the filler particles flowing through the second chamber to generate musical sounds. In one embodiment, a door is pivotally mounted in an intermediate plate fixed in the second chamber in the tubular member to momentarily delay the flow of filler particles flowing between the opposite ends of the tubular member. The door is responsive to the weight of filler particles disposed on the plate or to the quantity of filler particles remaining in the first chamber to open the aperture in the intermediate plate.

15 Claims, 4 Drawing Sheets

MUSICAL INSTRUMENT

BACKGROUND OF THE INVENTION

1. Field of the Invention

The present invention relates, in general, to musical instruments and, more particularly, to percussion instruments.

2. Description of the Art

A percussion instrument known in native cultures used a hollow tubular member, such as a plant stem, reed or cane, which was closed at each end. A quantity of particulate material, such as seeds, rocks, etc., was loosely disposed within the tubular member before the ends were closed. Pegs were driven through the sides of the tubular member substantially along the entire length thereof. As the tubular member was inclined at an angle away from horizontal, the particulate material which had been previously collected at one end of the tubular member flowed by gravity toward the other end and struck the pegs along the length of the tubular member creating a resonant, pleasing sound. This process could be repeated by inverting the tubular member in an opposite direction to cause the particulate material to flow back to the other end.

Various improvements and different, but related instruments, have been devised over the years which are derived from the above-described native instrument. Some of these newer instruments include baffles disposed intermediate the ends of the hollow member which divided the hollow member into several separate chambers, each filled with its own quantity of particulate material.

Due to the relatively small size of such instruments, the sounds generated as the particulate material flows from one end to the other are of relatively short duration and requires the instrument to be continually reinverted to continue the generation of the musical sounds. This quickly becomes a monotonous task.

Thus, it will be desirable to provide a percussion musical instrument employing internally movable particulate material which generates sounds for a longer time than similar previously devised musical instruments. It would also be desirable to provide such a musical instrument which creates a more resonant sound.

SUMMARY OF THE INVENTION

The present invention is a musical instrument in the for of a hollow, tubular member having side walls and closed, first and second, opposed ends. A plate is fixedly mounted within and spaced from one of the ends of the tubular member, such as the first end, to define a first chamber within the interior of the tubular member between the plate and the first end. The plate also creates a second chamber between itself and the opposed, second end. Alternately, a second plate may be disposed in and spaced from the second end of the tubular member to define a third chamber or reservoir, with the second chamber being situated between the first and second, spaced plates. An aperture is formed in and extends through each plate to dispose the first and third chambers in communication with the second chamber in the tubular member. Likewise, an aperture formed in the second plate disposes the third chamber in communication with the intermediate second chamber in the tubular member.

A plurality of tone pegs are mounted in and extend through the side walls of the tubular member into the second chamber of the tubular member. The tone pegs extend inward a predetermined distance such that the innermost end of each peg is spaced a short distance from the opposed side wall of the tubular member. Filler particles are loosely disposed within the tubular member and are movable, when the tubular member is disposed at an angle from horizontal, from the first chamber through the aperture in the first plate into the second chamber wherein the filler particles impinge on the tone pegs and generate sound as the filler particles pass through the second chamber to the opposite end of the tubular member.

In a preferred embodiment of the present invention, the tone pegs are arranged on only a portion of the side wall of the tubular member. In one embodiment, the tubular member is formed of multiple flat faces fixedly joined together at opposite side edges to form a polygonal cross section. The tone pegs are disposed in only certain of the flat faces, such as three flat faces in a hexagonal-shaped tubular member. Further, the tone pegs are arranged in groups, with a first group formed of a predetermined number of pegs disposed in one face, preferably in a row, a second group of a predetermined number of tone pegs disposed in another face, such as a second face adjacent to the first face, and spaced longitudinally from the tone pegs in the first face, and a third group of tone pegs formed in a third face such as the face adjacent to the second face, and spaced from the tone pegs in the second face. Other groups of tone pegs are disposed in the first, second and third faces and spaced from the tone pegs in the third face and the tone pegs in the same first, second and third faces substantially along the length of the second chamber of the tubular member.

The tone pegs in all of the groups of tone pegs may have the same length, or the tone pegs may very in length between each group, or they may be provided in randomly varying lengths over the length of the tubular member.

In an alternate embodiment, a third plate is mounted within the second chamber between the first and second ends of the tubular member. An aperture is formed in the third plate. Means are mounted on the third plate for releasably opening and closing the aperture in the third plate to momentarily delay the flow of filler particles through the second chamber.

In one embodiment, the means for opening and closing the aperture in the third plate comprises a pivotally mounted door mounted in the third plate. Co-operating magnets are disposed on one edge of the door and an adjoining portion of the third plate so as to position the door via magnetic attraction of the co-operating magnets in a co-linear arrangement with the surrounding third plate. In this position, the door closes the aperture and prevents the flow of filler particles into the adjoining portion of the tubular member. In response to a predetermined weight of filler particles disposed on an upper surface of the third plate, the weight of the particles will overcome the magnetic attraction between the co-operating magnets and pivot the door downwardly which opens the aperture and allows the filler particles to flow through the rest of the tubular member.

In another embodiment, an elongated rod slidably extends through a separate aperture formed in the first plate and an aperture in the third plate. The rod includes a float means mounted at an upper end which rests upon the top surface of the filler particles disposed in the first chamber in the tubular member. The flow of filler particles from the first chamber into the second chamber of the tubular member will cause the rod to move downward toward the second end of the tubular member via the float means. An intermediate portion of the rod is formed with a narrowed down diameter which slidably engages the aperture in the third plate when substantially all of the filler particles have exited the first chamber. The narrowed down portion opens the aperture in the third plate and allows the filler particles to flow through the aperture in the third plate about the narrow diameter portion of the rod into the remainder of the tubular member.

The musical instrument of the present invention provide pleasing musical sounds over a longer time period than similar musical instruments. The number and lengths of tone pegs and their respective spacing and arrangement on only certain portions or faces of the side wall of the tubular member creates a more resonant sound as the filler particles contact more of the free ends of the tone pegs which are spaced from an adjacent side wall of the tubular member.

The musical instrument of the present invention may also be provided with means for releasably opening an aperture formed in a plate situated in the second chamber of the tubular member to delay the flow of filler particles through the musical instrument. This momentarily delays the flow of such filler materials through the musical instrument so as to increase the amount of time during which the filler particles generate musical sound.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
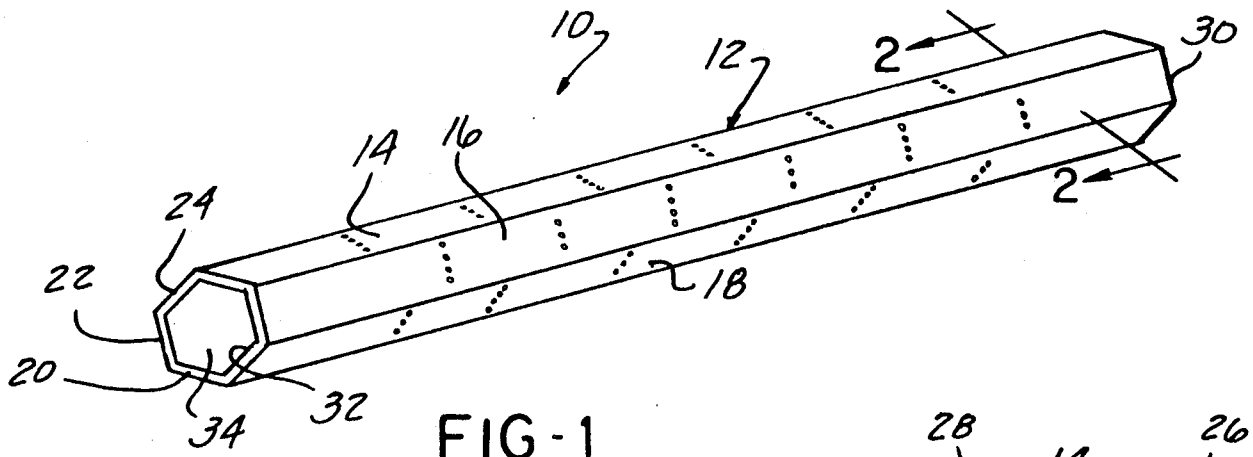
FIG. 1 is a perspective view of a musical instrument constructed in accordance with the teachings of the present invention.

Referring now to the drawing, and to FIGS. 1–5 in particular, there is illustrated a musical instrument 10 which generates percussion-type musical sounds. The musical instrument 10 is in the form of a hollow, tubular member 12 which may be formed of any suitable material, such as bamboo, tempered steel, wood, such as birch and other materials, which are light, resilient and resonant. For example, white pine could be employed as a material for forming the tubular member 12.

The tubular member 12 may have any suitable length, such as 2½ feet or five feet. Further, the cross sectional dimensions, or diameter which may typically range between 1½ to three inches in an exemplary embodiment of the present invention, may also be varied to suit the requirements for a particular size musical instrument.

The hollow tubular member 12 may have any cross sectional shape, such as circular, as well as various polygonal shapes, including triangular, square, pentagonal, hexagonal, octagonal, etc. Although a hexagonal cross section is illustrated in the drawings and described hereafter, it will be understood that this configuration is described and depicted by way of example only as any other shape may be employed in the musical instrument of the present invention.

Thus, in an exemplary embodiment the tubular member 12 is formed of six identically-shaped faces, such as a first face 14, a second face 16, a third face 18, a fourth face 20, a fifth face 22 and a sixth face 24. The side edges, such as side edges 26 and 28 for the first face 14, are mitered and secured together by suitable means, such as an adhesive, to the adjoining edges of the adjacent faces to form the completed hollow tubular member 12.

The tubular member 12 has first and second, opposed ends 30 and 32, respectively. The first and second ends 30 and 32 are preferably closed by end plates, such as end plate 34 for the second end 32 of the housing 12. Each end plate 34 has a shape complimentary to the shape of the cross section of the tubular housing 12 so as to fit securely therein. Each of the end plates 34 is secured to the tubular member 12 by an adhesive, or by fasteners, such as screws, dowels, etc.

Figure 5:
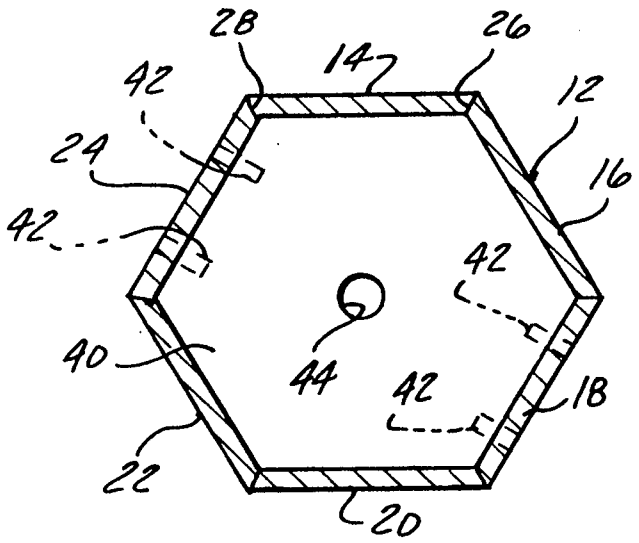
FIG. 5 is a cross sectional view generally taken along line 5—5 in FIG. 3.
Figure 3:
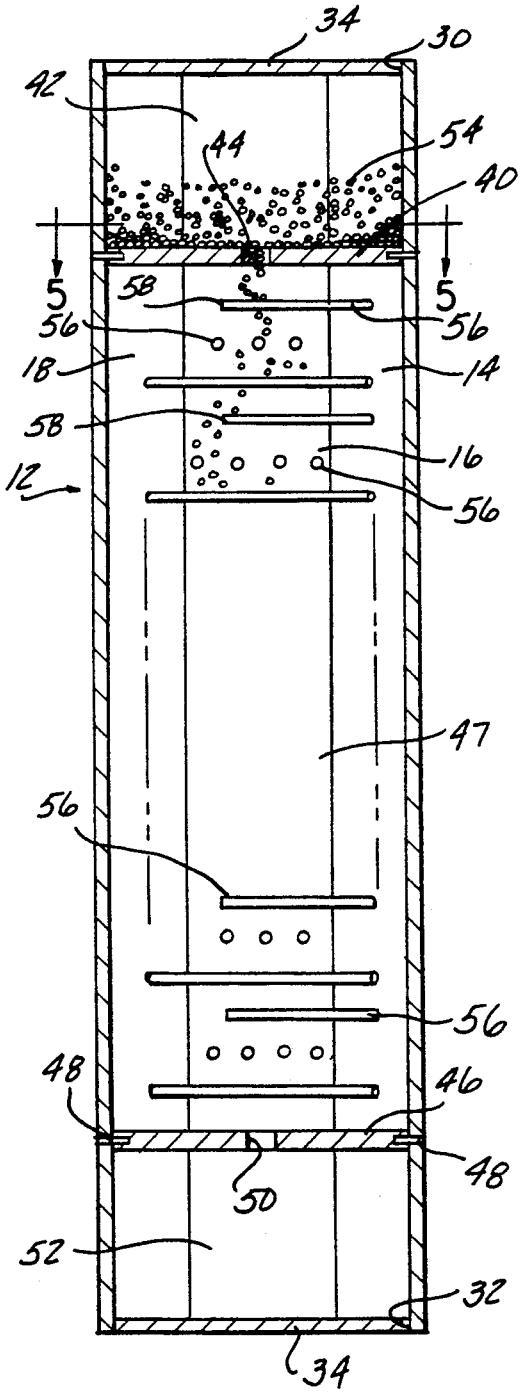
FIG. 3 is a longitudinal cross sectional view of the musical instrument shown in FIG. 1.

The end plates 34 located at the first and second ends 30 and 32, respectively, of the tubular member 12 form a closed, hollow interior within the tubular member 12. As shown in FIGS. 3 and 5, a first plate 40 is mounted within the interior of the tubular member 12 and spaced a predetermined distance from the first end 30 or first end plate 34 to create a first reservoir or chamber 42 adjacent the first end 30 of the tubular member 12. The first plate 40 has a hexagonal shape, as shown in FIG. 5, so as to be complimentary to the cross sectional shape of the tubular member 12. Suitable mounting means, such a dowels 42, may extend through certain of the side walls, such as opposed side walls 18 and 24 of the tubular member 12, to securely mount the first plate 40 in the desired position along the longitudinal length of the tubular member 12.

The first plate 40 has an aperture 44 formed therein and extending completely therethrough. The aperture 44 is preferably centrally located in the first plate 40 as shown in FIG. 5. The aperture 44 disposes the first chamber 42 in the tubular member 12 in communication with a second chamber adjacent to the first plate 40.

In a preferred embodiment, a second plate 46 identical to the first plate 40 is mounted in and spaced a predetermined distance from the second end 32 of the tubular member 12. The second plate 46 is held in position in the tubular member 12 by means of dowels 48 extending through certain opposed faces, such as faces 18 and 24, of the side wall of the tubular member 12. The second plate 46 includes a centrally located aperture 50 which disposes the second chamber 47 within the interior of the tubular member 12 in communication with a third chamber 52 formed between the second plate 46 and the end plate 34 at the second end 32 of the tubular member 12.

A predetermined quantity of loose, particulate, filler particles 54 is loosely disposed within the interior of the tubular member 12 and is flowable between the first and second ends 30 and 32 of the tubular member 12. The filler material 54 may be any suitable hard, non-breakable, smooth edged material, such as steel or lead shot, various grains, smooth pebbles, etc. For example, lead shot is illustrated in FIG. 3 as comprising the filler particles 54. Due to the small size of the filler particles 54, the apertures 44 and 50 in the first and second plates 40 and 46, respectively, have a correspondingly small diameter so as to allow the passage of only a few of the filler particles 54 therethrough at any one time, such as shown in FIG. 3. The quantity of filler particles 54 is chosen so as to substantially fill one of the first or second chambers or reservoirs 42 or 53 in the tubular member 12 when all of the filler particles 54 are disposed therein.

A plurality of tone pegs 56 are mounted in a portion of the side walls of the tubular member 12 and extend inward a predetermined distance into the second chamber 47 across the width of the tubular member 12. Each tone peg 56 has a generally tubular shape with either a circular or polygonal cross section. Each tone peg 56 extends from the side wall, or one of the faces forming the side wall of the tubular member 12, a predetermined distance toward the opposed side wall. The inner end 58 of each tone peg 56 is spaced from an adjacent side wall or face of the tubular member 12 by a predetermined gap or spacing such that each tone peg 56 is cantilevered within the tubular member 12 so as to resonate when struck by the filler particles 54 as described hereafter.

Figure 2:
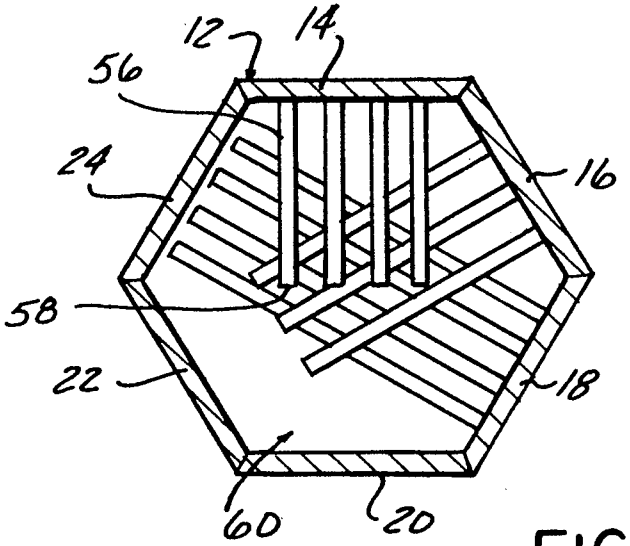
FIG. 2 is a cross sectional view generally taken along line 2—2 in FIG. 1.

Specially, one of the tone pegs 56 shown in FIGS. 2 and 3 extends from the first face 14 toward the opposed fourth face 20. The inner end 58 of the tone peg 56 is spaced from the fourth face 20 by a small gap denoted by reference number 60 in FIG. 2. The lengths of the tone pegs 56 are preferably identical for the tone pegs mounted in a particular face, such as the first face 14 shown in FIG. 2. The tone pegs 56 in adjacent faces, such as those in the second face 16 or the third face 18 may have the same length or vary in lengths. For example, the tone pegs 56 extending from the first face 14 may have a length of one inch, while the tone pegs 56 extending from the second face 16 may have a 1½ inch length and the tone pegs 56 extending from the third face 18 may have a two inch length. This provides various resonant sounds so as to create a more pleasing overall sound generated by the musical instrument 10. Of course, the tone pegs in all of the faces could have the same length or be provided in randomly varying lengths.

Figure 4:
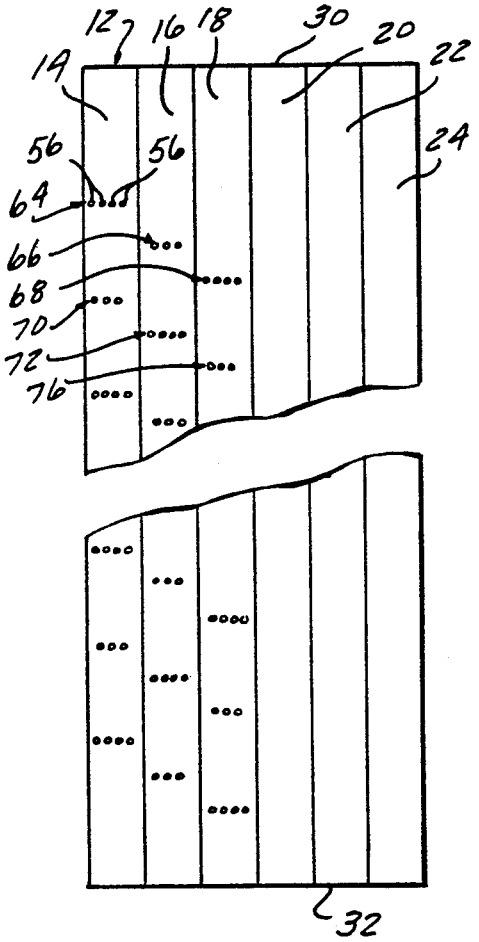
FIG. 4 is a plan view of the side wall of the tubular member of the musical instrument, with the various faces being flattened into a planar arrangement from their normal polygonal shape.

The tone pegs 56 are arranged in a predetermined pattern across certain of the faces of the tubular member 12. As shown in detail in FIG. 4, a predetermined number of tone pegs 56 are arranged in a row 64 in the first face 14. By way of example only, four tone pegs 56 are arranged in the first row 64. A predetermined number of tone pegs 56 are arranged in a second row 66 in the adjacent second face 16. By way of example only, three tone pegs comprise the second row 66. As shown in FIG. 4, the first and second rows 64 and 66 are spaced a predetermined distance apart. In this example, a third row 68 of a predetermined number of tone pegs 56 is mounted in the third face 18. Four tone pegs form the third row 68 in this example. The third row 68 is likewise spaced a predetermined distance from the second row 66. The spacing between each of the rows 64, 66 and 68 of tone pegs 56 may be identical or may be varied as desired. The exemplary arrangement of the tone pegs 56 continues with a fourth row 70 of a predetermined number of tone pegs 56 mounted in the first face 14. The fourth row 70 is spaced a predetermined distance along the longitudinal axis of the tubular member 12 from the third row 68. Three tone pegs are illustrated by way of example as forming the fourth row 70. Similarly, a fifth row 72 containing four tone pegs 56 and a sixth row 76 containing three tone pegs 56 are respectively mounted in the second and third faces 16 and 18 of the tubular member 12. This exemplary arrangement of tone pegs 56 in various spaced and staggered rows along the length of the tubular member 12 in which the tone pegs extend inward into the second chamber 47 in the tubular member is repeated along substantially the entire length of the second chamber 47. It will be understood that other numbers of tone pegs may be used to form each row as well as different size and different length tone pegs in each row or in the rows in adjacent faces of the tubular member 12. Further, each row of tone pegs could be mounted on a non-adjacent face from the other rows so as to provide an alternating arrangement of the tone pegs in every other face of the hexagonal tubular member 12 shown in FIG. 1.

When viewed from the first end 30 of the tubular member 12, as shown in FIG. 2, the tows of tone pegs 56 overlap along the length of the tubular member 12 to provide a criss-cross arrangement of tone pegs 56 which are struck by the filler particles 54 as such filler particles 54 flow through the aperture 44 in the first plate 40 through the second chamber 47.

In use, it is desirable to initially have substantially all of the filler particles 54 collected into one of the first or third reservoirs 42 and 52. To achieve this, the tubular member 12 is oriented vertically with its first end 30 lowermost until substantially all of the filler particles 54 have flowed into the first chamber 42 through the aperture 44 in the first plate 40.

The tubular member 12 is then inverted with the first end 30 being raised upward from a horizontal position to a predetermined angle from horizontal, but preferably not completely vertical. In this position, the filler particles 54 flow piecewise through the aperture 44 in the first plate 40 into and through the second chamber 47. As the filler particles 54 flow through the second chamber 47, the filler particles 54 strike and impinge on the overlapping arrangement of tone pegs 56 creating a pleasing resonant sound caused by vibration of the tone pegs 56 due to the impinging of the filler particles 54 thereon. This sound is like the sound of falling rain.

The filler particles 54 as they approach the second plate 46 will pass through the aperture 50 in the second plate 46 and be collected in the third chamber or reservoir 52 at the second end 32 of the tubular member 12. When substantially all of the filler particles 54 have been collected in the third chamber or reservoir 52, the tubular member 12 may be inverted with the second end 32 disposed uppermost such that the tubular member 12 is oriented at a predetermined downwardly extending angle from horizontal to cause the filler particles 54 to flow from the third chamber 52 back to the first chamber 42 through the second chamber 47 where they again strike and impinge on the tone pegs 56 and create the pleasing, musical sound.

Figure 6:
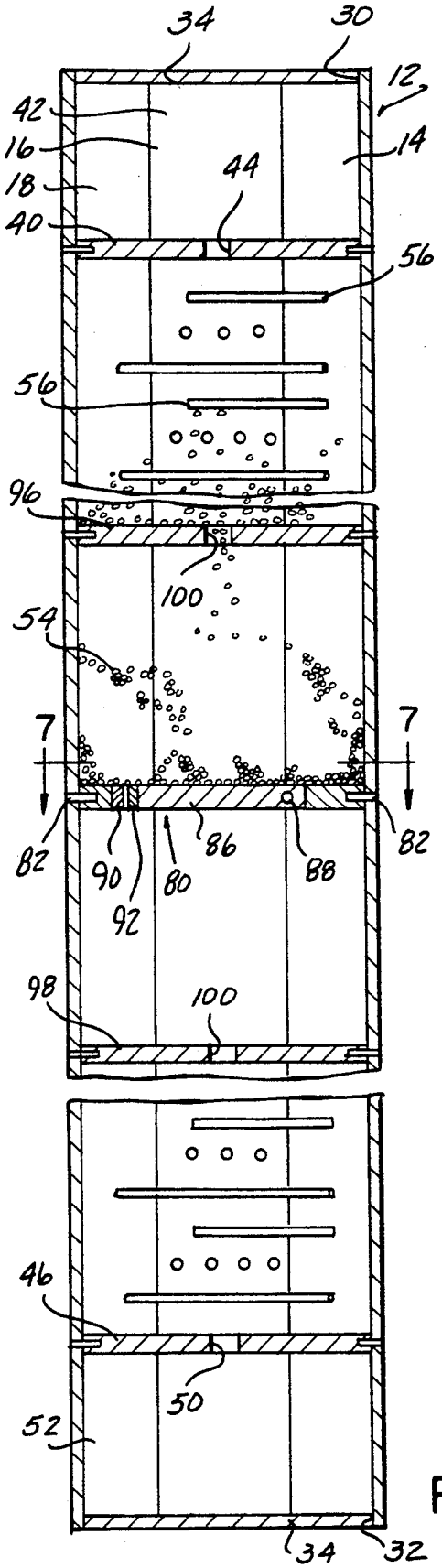
FIG. 6 is a longitudinal cross sectional view showing another embodiment of the musical instrument of the present invention.
Figure 7:
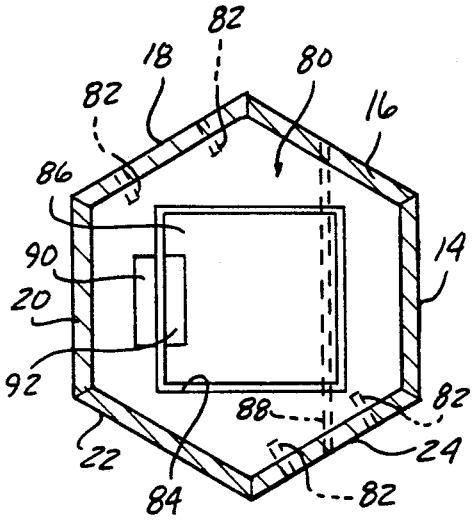
FIG. 7 is a cross sectional view generally taken along line 7—7 in FIG. 6.
Figure 8:
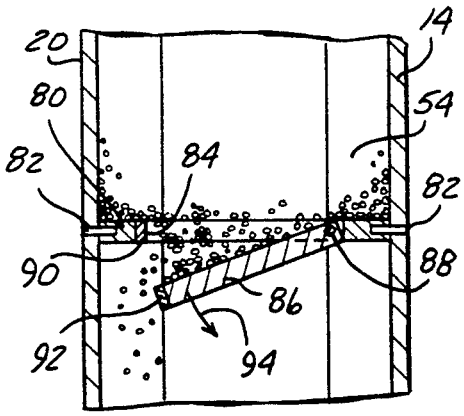
FIG. 8 is an enlarged, partial, cross sectional view showing the aperture opening and closing means in the embodiment of the invention shown in FIG. 6.

Referring now to FIGS. 6–8, there is depicted another embodiment of the present musical instrument which includes means for delaying the flow of filler particles 54 between the opposed ends 30 and 32 of the tubular member 12. In this embodiment, the delaying means comprises a third intermediately disposed plate 80 which is mounted at a predetermined position in the second chamber 47 by means of suitable fasteners, such as dowels 82 extending through two opposed side walls of the tubular member 12 into opposed edges of the third plate 80. The third plate 80 has a shape complimentary to the cross section of the tubular member 12, such as a hexagonal shape shown in FIG. 7, so as to snugly conform to the cross section of the tubular member 12. An aperture 84 is formed in the third plate 80 and is substantially centrally located within the third plate 80. By way of example only, the aperture 84 has a square cross section as shown in FIG. 7.

Means 86 are provided for releasably opening and closing the aperture 84 in the third plate 80. Such means 86 preferably comprises a planar door or flap which is pivotally mounted to the third plate 80 and, optionally, to two opposed side walls of the tubular member 12 by means of a hinge pin 88 extending through one end thereof. The releasing means 86, in one embodiment, comprises co-operating magnets 90 and 92 which are respectively mounted on one edge of the door 86 and an adjacent edge cf the portion of the third plate 80 bounding one edge of the aperture 84. The magnets 90 and 92 have opposed polarities so as to be magnetically attracted when brought into close proximity. The magnets 90 and 92 thus releasably hold the door 86 in substantial co-linear alignment with the planar third plate 80 as shown in FIG. 6, in which position, the door 86 closes the aperture 84 in the third plate 80. However, when the weight of a predetermined quantity of filler particles 54, which have accumulated on one surface of the door 86 exceeds the magnet attraction force between the magnets 90 and 92, such weight will pivot the door 86 about its pivot pin 88 in a direction indicated by arrow 94 in FIG. 8 thereby opening the aperture 84 in the third plate 80 and allowing the filler particles 54 to pass through the aperture 84 into the adjoining portion of the second chamber 47 of the tubular member 12. The door 86 may be reset to the closed position closing the aperture 84 in the third plate 80 by orienting the tubular member 12 in a horizontal position. The magnet means 90 and 92 operate in a bidirectional manner so as to be operable regardless of which end 30 or 32 of the tubular member 12 is oriented uppermost. When magnets 90 and 92 are used, the filler material 54 must be non-ferrous.

By way of example only, additional plates 96 and 98 are disposed on opposite sides of the third plate 80 to create additional intermediate chambers within the second chamber 47 of the tubular member 12. Such additional plates 96 and 98 each have a centrally located aperture 100 formed therein for the flow of the filler particles 54 therethrough in a piecewise manner. Each intermediate plate 96 and 98 also acts as a separate means for delaying the flow of the filler particles 54 through the length of the second chamber 47 and may be employed singly, or in the illustrated pair, or in combination with the third plate 80 and pivotal door 86 to provide increasing amounts of flow delay to the filler particles 54.

The embodiment shown in FIG. 6 also enables the tone pegs on opposite sides of the third plate 80 to optionally have a different configuration from the pegs on the other side of the third plate 80. Thus, the tone pegs may be provided in different numbers, lengths and/or arrangement for different sounds when the tubular member 12 is moved between its to sound generating positions. Further, although not shown, the third plate 80 could be a solid, non-movable member which divides the tubular member 12 into two separate chambers. The number, length and arrangement of tone pegs on each side may be different. In addition, the size of the filler material in each of the two chambers may also be different for different sounds. In this latter-described configuration, the additional plates 96 and 98 are used to form reservoirs on opposite sides of the third plate 80.

Figure 9:
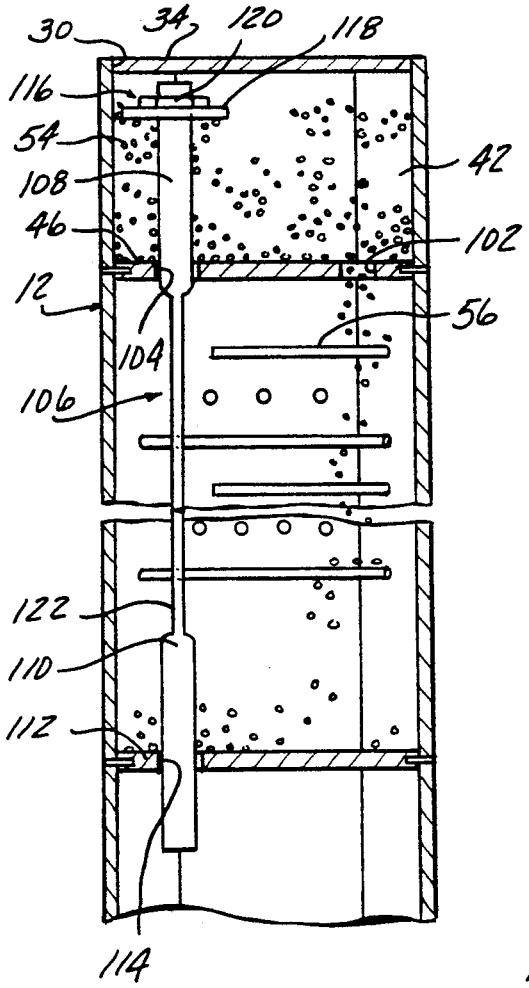
FIG. 9 is a partial, longitudinal cross sectional view of yet another embodiment of the musical instrument of the present invention.
Figure 10:
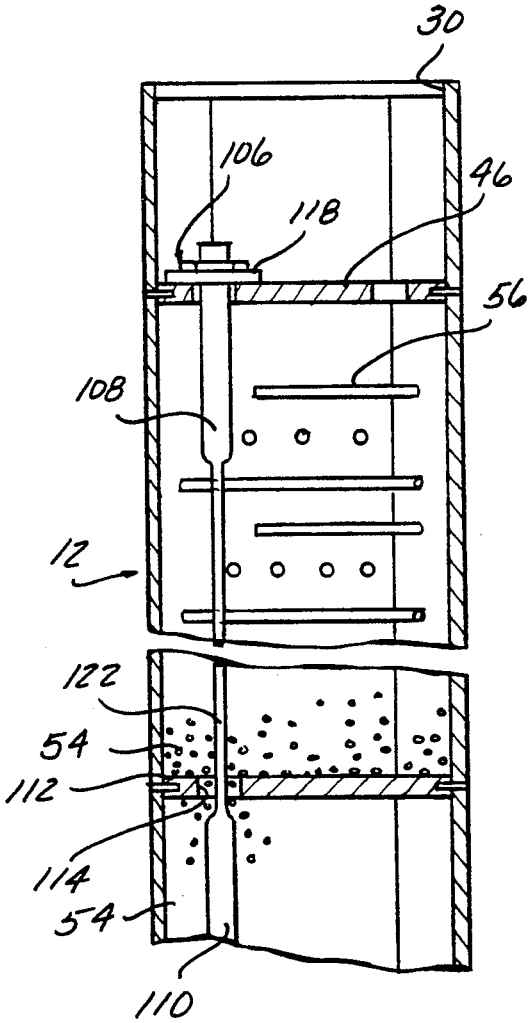
FIG. 10 is a partial, cross sectional view of the embodiment of the present invention shown in FIG. 9, depicting the closure rod in its downward, open position.

FIG. 9 and 10 depict yet another embodiment of the present invention which includes a different means for delaying the flow of filler particles 54 between the opposite ends of the tubular member 12. In this embodiment, the tubular member 12 is formed substantially identical to that described above and shown in FIG. 1. A first plate 46 is spaced from the first end 30 of the tubular member 12 to form a first chamber 42 therebetween. However, the first plate 46 in the embodiment shown in FIGS. 9 and 10 includes an aperture 102 which may be located at any position on the first plate 46. The aperture 102 allows for selected flow of the filler particles 42 from the first chamber 42 into an adjacent chamber in the tubular member 12. A second aperture 104 is also formed in the first plate 46 and slidably receives one end of a movable plunger or rod denoted in general by reference number 106. Tone pegs 56 arranged, as described above, are mounted in the tubular member 12 on a side of the first plate 46 opposite from the first chamber 42.

The plunger 106 has a first end portion 108 of a diameter only slightly smaller than the diameter of the aperture 104 in the first plate 46 so as to be slidably movable through the aperture 104 yet completely closes off the aperture 104 to the flow of filler particles 54 therethrough. The opposite end 110 of the plunger 106 also has the same diameter. This end portion 110 is slidably movable through an aperture 114 in a plate 112 fixedly mounted within the second chamber 47 of the tubular member 12. The enlarged end portion 110 of the plunger 106 is only slightly smaller than the diameter of the aperture 114 in the plate 112 so as to close off the aperture 114 to the flow of filler particles 54 therethrough when the end portion 110 of the plunger 106 is situated within the aperture 114.

The plunger 106 also includes float means 116 mounted adjacent the end of the first portion 108. The float means 116 preferably comprises an enlarged planar member 118, such as a washer, which is held in place on the end of the first portion 108 of the plunger 106 by a suitable fastener, such as a nut 120. The washer 118 acts as a level indicator by engaging the top surface of the accumulated filler particles 54 in the first chamber 42 in the housing 12. As such filler particles 54 flow through the aperture 102 in the first plate 46, the level of such filler particles 54 remaining in the first chamber 42 gradually decreases causing the plunger 106 to move downwardly toward the opposite second end of the tubular member 12 as the float 116 moves with the top level of the particles 54 in the first chamber 42.

When substantially all of the filler particles 54 have exited the first chamber 42, the float 116 will be positioned in close proximity to the first plate 46 as shown in FIG. 10. This downward movement of the plunger 106 brings a narrow diameter, central portion 122 of the plunger 106 into the aperture 114 in the plate 112. The diameter of the narrow portion 122 of the plunger 106 is chosen so as to open up a substantial portion of the aperture 114 for the flow of filler particles 54. In this manner, when substantially all of the filler particles 54 are situated in the first chamber 42, the enlarged second end portion 110 of the plunger 106 will be disposed in and block the aperture 114 in the plate 112 to the flow of filler particles through the plate 112. However, when substantially all of the filler particles 54 have flowed out of the first chamber 42 into the chamber formed between the first plate 46 and the plate 112, the float 116 will have lowered the plunger 106 to a position bringing the narrow central portion 122 of the plunger 106 into the aperture 114 thereby opening the aperture 114 to the flow of filler particles 54 which have accumulated on one side of the plate 112 through the aperture 114 into the chamber on the other side of the plate 114. This creates an intermittent stop and start flow of the filler particles 54 through the tubular member 12 which delays the flow of filler particles 54 through the tubular member 12 and increases the time of sound generation by the musical instrument 10.

It should be noted that the tone pegs 56 in the embodiment shown in FIGS. 9 and 10 are located between the first plate 46 and the plate 112. Other tone pegs are arranged as described above or in a different arrangement, numbers or lengths on the opposite side of the plate 112 between the plate 112 and the opposed second plate 46 located adjacent to the second end 32 of the tubular member 12. A similar plunger 106 and float means 116 may be slidably mounted in the second plate 46 adjacent the second end 32 of the tubular member and another intermediate plate disposed in the second chamber 46 to provide bi-directional delay of the flow of filler particles 54 through the tubular member 12.

In summary, there has been disclosed a unique musical instrument which provides pleasing musical sounds as a plurality of filler particles flow from one end to the other and strike tone pegs mounted in a spaced arrangement along the length of the instrument. The musical instrument may be provided with delaying means for increasing the amount of time required for the filler particles to flow between the opposite ends of the instrument and thereby increase the time of sound generation.

What is claimed is:

1. A musical instrument comprising:

a hollow tubular member having side walls and closed, first and second, opposed ends;

a plate fixedly mounted within and spaced from one end of the tubular member forms a first chamber in the tubular member between the first end and the plate and a second chamber between the plate and the second end of the tubular member, an aperture formed in and extending through the plate disposes the first chamber in communication with the second chamber in the housing;

a plurality of tone pegs mounted in the side walls of the tubular member and extending a predetermined distance into the second chamber of the tubular member, the innermost end of each of the tone pegs being spaced from the opposed side wall of the tubular member; and filler particles loosely disposed within the tubular member and movable, when the tubular member is disposed at an angle from horizontal, from the first chamber through the aperture in the plate into the second chamber whereby the filler particles impinge on and generate sound from contact with the tone pegs as the filler particles flow through the second chamber.

2. The musical instrument of claim 1 further comprising:

a second plate fixedly mounted in and spaced from the second end of the tubular member, the second plate forming a third chamber between itself and the second end of the tubular member; and an aperture formed in and extending through the second plate disposing the second and third chambers in communication for the flow of filler particles therebetween.

3. The musical instrument of claim 1 wherein:

the tone pegs are mounted in only a portion of the side walls of the tubular member.

4. The musical instrument of claim 1 wherein:

the side walls of the tubular member comprise a plurality of flat faces joined at opposite sides into a polygonal cross section.

5. The musical instrument of claim 4 wherein the tone pegs are mounted in only a predetermined number of the plurality of flat faces forming the tubular member.

6. The musical instrument of claim 3 wherein:

the tone pegs are arranged in the side walls of the tubular member in groups of predetermined number, each group being longitudinally spaced a predetermined distance from a group of tone pegs in an adjacent portion of the side wall of the tubular member.

7. The musical instrument of claim 6 wherein the spacing between the groups of tone pegs is identical along the length of the tubular member.

8. The musical instrument of claim 5 wherein:

the tone pegs are arranged in the side walls of the tubular member in groups of predetermined number, each group being longitudinally spaced a predetermined distance from a group of tone pegs in an adjacent portion of the side wall of the tubular member.

9. The musical instrument of claim 8 wherein the spacing between the groups of tone pegs is identical along the length of the tubular member.

10. The musical instrument of claim 8 wherein:

a first group of tone pegs is arranged in a first row in a first face of the tubular member;

a second group of tone pegs is arranged in a second row in a second face of the tubular member at a predetermined longitudinal space from the first row; and a third group of tone pegs is arranged in a third row in a third face of the tubular member at a predetermined longitudinal space from the second row.

11. The musical instrument of claim 10 wherein the predetermined longitudinal space between the first and second rows and between the second and third row is identical.

12. The musical instrument of claim 1 further comprising:

a third plate mounted in the second chamber of the tubular member between the first and second ends of the tubular member;

an aperture formed in and extending through the third plate;

chambers formed on opposite sides of the third plate and the opposite ends of the tubular member; and means, mounted on the third plate and responsive to a predetermined weight of filler particles disposed thereon, for releasably opening the aperture in the third plate for the flow of filler particles therethrough.

13. The musical instrument of claim 12 wherein the opening means comprises:

a door pivotally mounted in the third plate for closing the aperture in the third plate when in a normal position; and magnet means, mounted on the third plate and the door, for releasably holding the door in the normal position by magnetic attraction until the weight of the filler particles disposed on one side of the door exceeds the magnetic attraction force of the magnet means.

14. The musical instrument of claim 1 further comprising:

a third plate mounted in the second chamber of the tubular member between the first and second ends of the tubular member;

an aperture formed in and extending through the third plate;

means, responsive to the quantity of filler particles in the first chamber, for releasably opening the aperture in the third plate for the flow of filler particles therethrough.

15. The musical instrument of claim 14 wherein the opening means comprises:

first and second aligned apertures formed in the first and third plates, respectively;

a plunger movably extending through the first and second apertures in the first and third plates;

float means, mounted on a first end of the plunger for engaging the top surface of the filler particles and indicating the level of filler particles disposed within the first chamber of the tubular member;

the plunger having a small diameter central portion formed at a predetermined position along the length of the plunger, the small diameter portion being smaller than the diameter of the aperture in the third plate so as to open the aperture in the third plate when the small diameter portion of the plunger is disposed therebetween.

* * * * *

UNITED STATES PATENT AND TRADEMARK OFFICE

CERTIFICATE OF CORRECTION

PATENT NO. : 5,212,331
DATED : May 18, 1993
INVENTOR(S) : Geoferey S. Waldo

It is certified that error appears in the above-indentified patent and that said Letters Patent is hereby corrected as shown below:

On the Title page, item [76] inventor: delete "Geoferey" and insert --Geoffrey--.

Signed and Sealed this

First Day of February, 1994

Bruce Lehman

*Attest:*

BRUCE LEHMAN

*Attesting Officer*

*Commissioner of Patents and Trademarks*